United States Patent [19]

Kanda et al.

[11] Patent Number: 4,802,977

[45] Date of Patent: Feb. 7, 1989

[54] PROCESS FOR SIZE SEPARATING TONER PARTICLES

[75] Inventors: Hitoshi Kanda, Yokohama; Masayoshi Kato, Kawasaki, both of Japan

[73] Assignee: Canon Kabushiki Kaisha, Tokyo, Japan

[21] Appl. No.: 46,447

[22] Filed: May 6, 1987

[30] Foreign Application Priority Data

May 12, 1986 [JP] Japan ..... 61-106597

[51] Int. Cl.[4] ..... B07B 7/00; G03G 9/08

[52] U.S. Cl. ..... 209/143; 209/2; 209/146; 209/154; 430/137

[58] Field of Search ..... 209/2, 133, 136, 137, 209/139.1, 142, 143, 146, 154; 430/137

[56] References Cited

U.S. PATENT DOCUMENTS

| | | | |
|---|---|---|---|
| 2,222,861 | 11/1940 | Stoner | 209/154 X |
| 4,132,634 | 1/1979 | Rumpf et al. . | |
| 4,153,541 | 5/1979 | Rumpf et al. | 209/143 |
| 4,159,942 | 7/1979 | Greer et al. | 209/143 |
| 4,304,360 | 12/1981 | Luhr et al. . | |
| 4,551,240 | 11/1985 | Beppu et al. | 209/143 |
| 4,657,667 | 4/1987 | Etkin | 209/143 X |

FOREIGN PATENT DOCUMENTS

| | | | |
|---|---|---|---|
| 1905106 | 8/1970 | Fed. Rep. of Germany | 209/143 |
| 2642884 | 3/1978 | Fed. Rep. of Germany | 209/143 |
| 0825189 | 5/1981 | U.S.S.R. | 209/142 |
| 0865430 | 9/1981 | U.S.S.R. | 209/143 |
| 1587636 | 4/1981 | United Kingdom . | |

*Primary Examiner*—Robert B. Reeves
*Assistant Examiner*—Edward M. Wacyra
*Attorney, Agent, or Firm*—Fitzpatrick, Cella, Harper & Scinto

[57] ABSTRACT

A process for classifying toner particles supplied through a supply nozzle into at least three fractions in a classifying chamber divided into at least three sections and placed under a reduced pressure under the action of the inertia force of the toner particles supplied together with a gas stream and the centrifugal force of the curved gas stream due to Coanda effect. A first gas introduction pipe and a second gas introduction pipe are disposed above the classifying chamber so as to provide a first inlet and a second inlet opening with the first inlet being disposed closer to the supply nozzle than the second inlet. The absolute values of the static pressures $P_1$ and $P_2$ in the first and second gas introduction pipes are controlled so as to satisfy the relations of: $|P_1| \geqq 150$ mm.aq., $|P_2| \geqq 40$ mm.aq. and $|P_1| - |P_2| \geqq 100$ mm.aq.

10 Claims, 3 Drawing Sheets

PROCESS FOR SIZE SEPARATING TONER PARTICLES

FIELD OF THE INVENTION AND RELATED ART

The present invention relates to a process for producing a toner having a predetermined particle size for developing electrostatic images, by effectively classifying solid particles containing a binder resin.

In image forming processes such as electrophotography, electrostatic photography and electrostatic printing, a toner is used to develop an electrostatic image. In order to produce a toner for developing electrostatic images, that is, a final product of fine particles, particles of a starting material after pulverization are classified to obtain the final product. Such a process involves melt-kneading starting materials such as a binder resin and a coloring agent (e.g., dye, pigment or magnetic material), cooling the kneaded mixture for solidification followed by pulverization. Solid particles obtained after pulverization are introduced into a classifier for removing fine particle fraction to obtain a product having a prescribed particle size range.

The particle size used herein is expressed in terms of a weight-average particle size based on the results of measurement, e.g., by a Coulter counter available from Coulter Electronics, Inc. (U.S.A.). This is hereinafter simply referred to as "average particle size" or "weight-average particle size".

For example, to provide a group of particles having a weight average particle size of 10 to 15 microns and containing 1% or less of particles having a particle size smaller than 5 microns, feed particles are subjected to classification by means of a gas stream classifier or a mechanical classifier to remove fine particles with a size below the prescribed value, whereby a product of desired size is obtained.

Such a conventional process involves a problem that the residence time in a conventional classifier is so long as several minutes so that fine particles can be aggregated into larger particles which are difficult to remove as fine particles. As a result, the aggregates can be mixed into a final product so that it becomes difficult to obtain a product with an accurate particle size distribution. Further, such aggregates can be disintegrated during the use of the product toner to cause degradation in image quality. These problems are pronounced if a product with a smaller prescribed size is desired.

SUMMARY OF THE INVENTION

It is an object of the present invention to provide a process for producing a toner for developing electrostatic images, wherein the above mentioned various problems found in the prior art processes are overcome. A more specific object of the invention is to provide a process for effectively producing a toner for developing electrostatic images with an accurate particle size distribution.

Another object of the invention is to provide a process for effectively producing a toner with good quality and a small particle size (e.g., weight-average particle size of about 2–8 μm).

Another object of the invention is to provide a process for producing a toner for developing electrostatic images with less aggregates of very fine particles.

A further object of the invention is to provide a process for effectively producing a toner for developing electrostatic images which is capable of easily controlling a classification point.

More specifically, the present invention relates to a process for producing a fine particle product (used as a toner) having an accurate and prescribed particle size distribution by effective classification in short time of solid particles obtained through melt-kneading, cooling and pulverization of a mixture of a binder resin, a colorant and various additives.

The present invention further relates to a process for effectively classifying in short time of a polymerization toner produced by suspension polymerization.

According to the present invention, there is provided a process for producing a toner for developing electrostatic latent images, comprising:

generating a reduced pressure in a classifying chamber which is divided into at least three sections including a coarse powder section having a first outlet for withdrawing a coarse powder, a medium powder section having a second outlet for withdrawing a medium powder, and a fine powder section having a third outlet for withdrawing a fine powder, by sucking the classifying chamber through at least one of the first to third outlets;

supplying to the classifying chamber a feed toner material comprising toner particles of 20 μm or less in particle size in a proportion of 50% or more by number through a supply pipe having a supply nozzle opening into the classifying chamber at a velocity of 50 m/sec to 300 m/sec along with a gas stream flowing through the pipe;

controlling the absolute value of a static pressure $P_1$ to 150 mm.aq. or above in a first gas introduction pipe having a first gas inlet opening into the classifying chamber at a position upstream of the first gas inlet by a first gas introduction control means;

controlling the absolute value of a static pressure $P_2$ to 40 mm.aq. or above in a second gas introduction pipe having a second gas inlet opening into the classifying chamber at a position just upstream of the second gas inlet by a second gas introduction control means, the second gas inlet being disposed farther than the first gas inlet with respect to the supply nozzle; and distributing the feed toner material supplied to the classifying chamber into at least the coarse powder section, the medium powder section and the fine powder section under the action of the inertia force of the feed toner particles in the gas stream and the centrifugal force of the curved gas stream due to Coanda effect and under a condition where the absolute value $|P_1|$ of the static pressure $P_1$ and the absolute value $|P_2|$ of the static pressure $P_2$ satisfy the relation of $|P_1| - |P_2| \geqq 100$ (mm.aq.).

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

In the process of the present invention, feed toner particles obtained through pulverization or polymerization are supplied to a multi-division classifying zone or chamber to be classified into at least three particle size fractions including a large particle size fraction (coarse powder comprising primarily coarse particles), a medium particle size fraction (medium powder comprising primarily particles having a particle size within a prescribed or defined range) and a small particle size fraction (fine powder comprising primarily particles having a paticle size smaller than the prescribed range), and each particle size fraction is taken out from the multi-division classifying zone through an appropriate take-out or withdrawal means.

The particles of the medium particle size fraction thus taken out have a suitable particle size distribution and may be used as they are. On the other hand, it is possible to reuse the particles of the small particle size fraction by recycling them to the melt-kneading step. The particles of the large particle size fraction may be reused by recycling them to the pulverization step.

Figure 1:
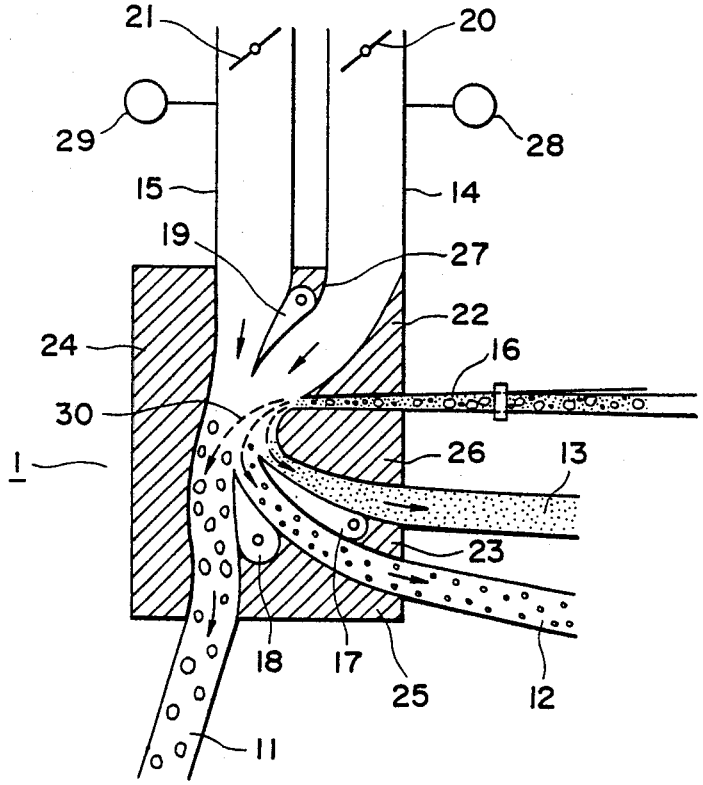
FIGS. 1 and 2 are a front sectional view and a sectional perspective view, respectively, of an apparatus embodiment for practicing multi-division classification according to the present invention.
Figure 2:
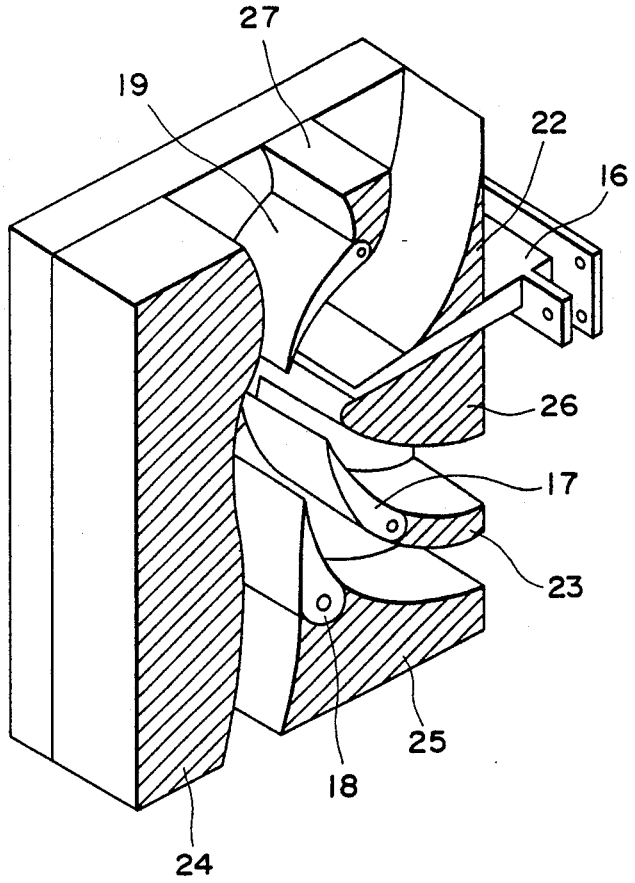

An embodiment for providing such a multidivision classifying means may for example be a multidivision classifier as shown in FIG. 1 (sectional view) and FIG. 2 (perspective view). Referring to FIGS. 1 and 2, the classifier has side walls 22, 23 and 24, and a lower wall 25. The side wall 23 and the lower wall 25 are provided with knife edge-shaped classifying wedges 17 and 18, respectively, whereby the classifying zone is divided into three sections. At a lower portion of the side wall 22, a feed material supply nozzle 16 opening into a classifying chamber is provided. A Coanda block 26 is disposed along the lower tangential line of the nozzle 16 so as to form a long elliptic arc shaped by folding the tangential line downwardly. The classifying chamber has an upper wall 27 provided with a knife edge-shaped gas-intake wedge 19 extending downwardly. Above the classifying chamber, gas-intake pipes 14 and 15 opening into the classifying chamber are provided. In the intake pipes 14 and 15, a first gas introduction control means 20 and a second gas introduction control means 21, respectively, comprising, e.g., a damper, are provided; and also static pressure gauges 28 and 29 are disposed communicatively with the pipes 14 and 15, respectively. The locations of the classifying wedges 17, 18 and the gas-intake wafer 19 may vary depending on the kind of the feed material to be classified and the desired particle size. At the bottom of the classifying chamber, outlets 11, 12 and 13 are disposed corresponding to the respective classifying sections and opening into the chamber. The outlets 11, 12 and 13 can be respectively provided with shutter means like valve means.

The feed material supply pipe 16 comprises a flat rectangular pipe section and a tapered rectangular pipe section, and it is preferred in order to obtain an appropriate introduction speed that the ratio between the internal size of the flat rectangular pipe section and the narrowest part of the tapered rectangular pipe section is 20:1 to 1:1, particularly 10:1 to 2:1.

A classifying operation is effected by using the above described multi-division classifying chamber or zone as follows. The classifying chamber is sucked or evacuated to a reduced pressure through at least one of the outlets 11, 12 and 13. A feed toner powder material is supplied to the classifying chamber through the feed supply nozzle 16 along with a gas stream flowing at a rate of 50–300 m/sec, preferably 70–200 m/sec. At that time, the first gas stream introduction control means 20 and the second gas stream introduction control means 21 are driven so that the absolute value of a static pressure (gauge pressure) $P_1$ at a position in the intake pipe 14 upstream of the inlet (downstream end of the pipe) opening into the classifying chamber is 150 mm.aq. or above, preferably 200 mm.aq. or above, further preferably 210 to 1000 mm.aq.; the absolute value of a static pressure $P_2$ (gauge pressure) at a position in the intake pipe 15 upstream of the inlet opening into the classifying chamber is 40 mm.aq. or above, preferably 45 to 400 mm.aq., further preferably 45 to 70 mm.aq.abs.; and the absolute values $|P_1|$ and $|P_2|$ satisfying the relation: $|P_1|-|P_2| \geqq 100$ (mm.aq.). The pressures are measured downstream of the gas stream control means 20 and 21. The absolute value of the static pressure $P_2$ in the range of 45–70 mm.aq. is especially preferred because fine particles and coarse particles are more broadly distributed in the classifying zone so that the control of the classifying point becomes easier. Further preferably, the absolute values of the static pressures $P_1$ and $P_2$ satisfy the relations of $150 \leqq |P_1|-|P_2| \leqq 700$, and $|P_1|/|P_2|=2$ to 10 (preferably 4 to 6).

When $|P_1|-|P_2|<100$ (mm.aq.), the classification accuracy is lowered and it becomes impossible to accurately remove the fine powder fraction, so that the resultant classified product is caused to have a broad particle size distribution. When the feed toner powder material is supplied to the classifying chamber at a rate below 50 m/sec, the aggregation of the feed powder cannot be sufficiently disintegrated, thus lowering the classification yield and the classification accuracy. When the feed toner material is supplied to the classifying zone at a rate of above 300 m/sec, the toner particles can be pulverized because of collision therebetween to newly produce fine particles, thus tending to lower the classification accuracy.

The feed toner particles thus supplied are caused to fall along curved lines 30 due to the Coanda effect given by the Coanda block 26 and the action of the streams of a gas such as air, so that larger particles (coarse particles) fall along an outward gas stream to form a fraction outside the classifying wedge 18, medium particles (particles having sizes in the prescribed range) form a fraction between the classifying wedges 18 and 17, and small particles (particles having sizes below the prescribed range) form a fraction inward of the classifying wedge 17. Then, the large particles, the medium particles and the small particles are withdrawn through the outlets 11, 12 and 13, respectively.

Figure 3:
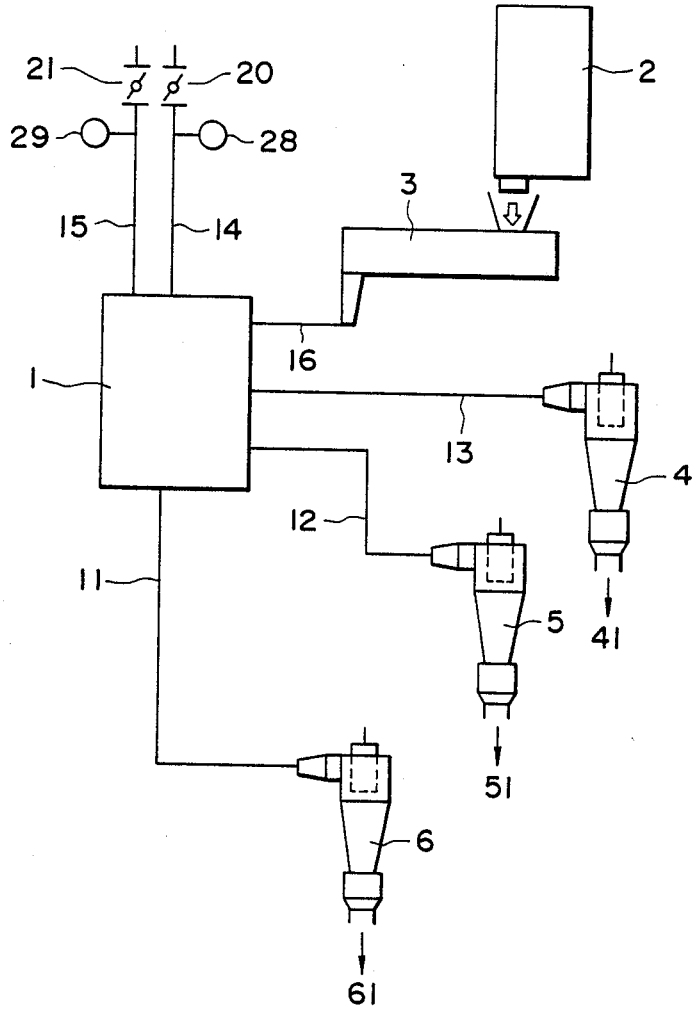
FIG. 3 is a schematic view illustrating a classification apparatus system for practicing the process according to the present invention.

The above process may be generally operated by using a system in which the classifier is connected with other apparatus by communicating means such as pipes. A preferred embodiment of such an apparatus system is shown in FIG. 3. The apparatus system shown in FIG. 3 comprises a three-division classifier 1 as explained with reference to FIGS. 1 and 2, a metering feeder 2, a vibration feeder 3, a collecting cyclone 4, a collecting cyclone 5 and a collecting cyclone 6 connected through communication means. The supply of the feed toner material from the metering feeder 2 to the vibration feeder 3 is performed in an open system.

More specifically, in the apparatus system, the feed toner material is supplied to the metering feeder 2 by appropriate means, and through the vibration feeder 3 and the feed supply nozzle 16, introduced into the three-division classifier at a velocity of 50–300 m/sec. As the size of the classifying zone or chamber in the classifier 1 is generally on the order of (10–50 cm)×(10–50 cm), the feed toner particles can be generally classified into three or more particle size fractions in a short period of 0.1 sec to 0.01 sec or less. In the three-division classifier 1, the feed toner material is divided into the large particles (coarse particles), the medium particles (particles with sizes in the prescribed range) and the small particles (particles with sizes below the prescribed range). The large particles are then sent through an exhaust pipe 11 to the collecting cyclone 6 to be recovered. The medium particles are withdrawn out of the system through an exhaust pipe 12 and collected by the collecting cyclone 5 to be recovered as a toner product 51. The small particles are withdrawn out of the system through an exhaust pipe 13 and collected by the collecting cyclone 4 to be recovered as fine powder 41 with sizes outside the prescribed range. The collecting cyclones 4, 5 and 6 function as suction and reduced pressure-generation means for introducing the feed powder material through the nozzle 16 into the classifying chamber. A commercially available apparatus which may be suitably used in the present invention may includes the ELBOW JET ®multi-division classifier available from Nittetsu Kogyo K.K.

As described above, according to the process of the present invention, particles including toner particles obtained through pulverization or polymerization of a toner material are effectively and rapidly classified into a particle fraction comprising particles with sizes in a prescribed range and having an accurate particle size distribution. In a conventional classification system using a fixed wall-type classifier or a rotational classifier, aggregates of fine particles causing fog of developed images are liable to be formed. Further, when such aggregates are formed, it is difficult to separate them from the medium particle size fraction in the conventional classification system. According to the process of the invention, however, the aggregates, even if formed, are disintegrated due to the Coanda effect and/or high-speed movement into fine particles which are separated from the medium particles. Further, even if some aggregates are not disintegrated, they can be simultaneously separated as coarse particles, whereby the aggregates can be effectively removed as a whole to increase the classification yield.

A toner for developing electrostatic images according to the pulverization process may be generally prepared by melt-kneading the starting materials including a binder resin such as a styrene resin, a styrene-acrylic resin or a polyester resin (ordinarily in an amount of 25–90 wt. % of the toner); a colorant such as carbon black or phthalocyanine blue (ordinarily 0.5–20 wt. % of the toner) and/or a magnetic material (ordinarily 10–70 wt. % of the toner); an antioffset agent such as low-molecular weight polyethylene, low-molecular weight polypropylene or paraffin wax (ordinarily, 0.1–10 wt. % of the toner); and a positive or negative charge control agent (ordinarily, 0.1–10 wt. % of the toner), followed by cooling, pulverization and classification. In case of production of a toner through the pulverization process, it is difficult to obtain a uniform melt dispersion of the starting materials in the kneading step so that the pulverized particles can include particles which are not suitable as toner particles commingled therein, such as those free of a colorant or magnetic particle or comprising an individual particle of a single starting material. In the conventional process involving a long residence time in the classification stage such unsuitable particles are liable to aggregate with each other and it is difficult to remove the resultant aggregates, so that toner characteristics are remarkably impaired thereby. In contrast thereto, in the process of the invention, the feed particles are classified into three or more fractions so that such aggregates are not readily formed, and even if formed, they can be removed into the fine particle fraction or the coarse particle fraction. As a result, a toner product comprising particles of a uniform mixture and having an accurate particle size distribution is obtained.

A polymerization toner is prepared by subjecting a monomer composition comprising at least a polymerizable monomer and a colorant to suspension polymerization in the presence of a polymerization initiator and a dispersion stabilizer. Even if the dispersion stabilizer particles are allowed to remain in the polymerization toner particles, the stabilizer particles can be effectively separated from the toner particles according to the classification process of the present invention.

A toner produced by the process of the present invention has a stable triboelectric charge provided by friction between the toner particles, or between the toner and a toner carrying member such as a sleeve or carrier. Development fog and scattering of toner around the edge of a latent image, which have not been fully solved heretofore, are extremely reduced, and a high density of image is achieved, leading to a good reproducibility of half tone. Even in the continuous use of a developer including the toner over a long period, an initial performance can be maintained and high quality images can be provided over a long period. Further, even in the use of the toner under environmental conditions of a high temperature and a high humidity, the triboelectric charge of the developer is stable and little vary as compared with that when used under normal temperature and normal humidity, because the presence of extremely fine particles and the aggregate thereof are reduced. Threfore, the fog and decrease in density of image are reduced, enabling the development of images faithful to latent images. Moreover, the resulting toner images have an excellent transfer efficiency to a transfer material such as a paper. Even in the use of the toner under the conditions of a low temperature and a low humidity, a distribution of triboelectric charge is little different from that in the use at normal temperature and normal humidity, and because the extremely fine particle component having an extremely large charge has been removed, the toner produced by the process of the present invention has such characteristics that there occur little reduction in density of image and little fog, and roughening and scattering during transfer hardly occur.

In producing a toner powder having a smaller particle size (e.g., an average particle size of 3 to 7μ), the process ff the present invention can be carried out more effectively than the prior art process is.

The present invention will now be described in detail by way of Examples.

EXAMPLE 1

| | |
|---|---|
| Styrene-acrylic acid ester resin (weight ratio of styrene to the acrylic ester 7:3, weight-average molecular weight of about 300,000) | 100 wt. parts |
| Magnetite | 60 wt. parts |

-continued

| | |
|---|---|
| (particle size: 0.2μ) | |
| Low molecular weight polyethylene (weight-average molecular weight of about 3,000) | 2 wt. parts |
| Negatively chargeable control agent (Bontrone E81) | 2 wt. parts |

A toner feed material of a mixture having the above prescription was melt-kneaded at 180° C. for about 1.0 hour, and cooled for solidification. The resulting mixture was roughly pulverized into particles of 100 to 1,000 microns in a hammer mill and then moderately pulverized into a weight-average particle size of 100 μm in ACM pulverizer available from Hosokawa Micron K.K. Then, the pulverized material was further pulverized by means of a hypersonic speed jet mill (PJM-I-10, mfd. by Nippon Pneumatic Kogyo K.K.) into a pulverized material having a weight-average particle size of 10.9 μm (containing 11.1 wt. % of particles having sizes below 5.04 μm and 4.1 wt. % of particles having sizes above 20.2 μm). The pulverized material was classified in an apparatus system as shown in FIG. 3 including a multi-division classifier 1 as shown in FIGS. 1 and 2 ELBOW JET® EJ-45-3 model, available from Nittetsu Kogyo K.K.), into which the pulverized material was introduced at a rate of 2.0 kg/min to be classified into three fractions including a coarse powder, a medium powder and a fine powder under utilization of the Coanda effect.

For effecting the introduction, the collecting cyclones 4, 5 and 6 communicated with the outlets 11, 12 and 13 were operated to generate a reduced pressure in the classification chamber, by which the pulverized material was introduced at a velocity of about 100 m/sec through the supply nozzle 16. At this time, the static pressure $P_1$ in the intake pipe 14 at a point upstream of the inlet to the chamber was controlled at −280 mm.aq., i.e. −280 mm $H_2O$ (gauge), and the static pressure $P_2$ in the intake pipe 15 was controlled at −60 mm.aq. The introduced particles were classified in an instant of 0.01 second or less. A medium powder suitable as a toner was collected in a yield of 83 wt. % in the collecting cyclone 5 for collecting the classified medium powder, and had a weight-average particle size of 11.5μ (containing 0.3 wt. % of particles having a particle size of below 5.04μ and 0.1 wt. % or less, i.e., a substantially negligible amount, of particles having a particle size of 20.2μ or more). As used herein, the term "yield" refers to a percentage of the amount of the medium powder finally obtained based on the total weight of the powdered material fed. Substantially no aggregate of about 5μ or larger resulting from the aggregation of extremely fine particles was found by the observation of the obtained medium powder through an electron microscope.

The obtained medium powder showed a negative chargeability with respect to a sleeve of aluminum or stainless steel and was electrically insulating. The medium powder was used as a toner, and 0.3% by weight of hydrophobic silica was mixed with the toner to prepare a developer. The prepared developer was supplied to a copier NP-270 RE (available from Canon K.K.) to effect a copying test. The results showed that copied images having no fog and a good developing property for thin lines were provided.

COMPARATIVE EXAMPLE 1

A pulverized material having a weight-average particle size of 10.9 μm produced in the same manner as in Example 1 was introduded at a rate of 2.0 kg/min and classified in the same apparatus system used in Example 1.

For effecting the introduction, the collecting cyclones 4, 5 and 6 communicated with the outlets 11, 12 and 13 were operated to generate a reduced pressure in the classification chamber, by which the pulverized material was introduced at a velocity of about 80 m/sec through the supply nozzle 16. At this time, the static pressure $P_1$ in the intake pipe 14 was controlled at −70 mm.aq., and the static pressure $P_2$ in the intake pipe 15 was controlled at −50 mm.aq.

A medium powder as a toner was collected in a yield of 60 wt. % in the collecting cyclone 5 for collecting the classified medium powder, and had a weight-average particle size of 11.2 microns (containing 1.5 wt. % of particles having a particle size of below 5.04μ and 2.0 wt. % of particles having a particle size of 20.2μ or more). The observation of the medium powder through an electron microscope showed that aggregate of about 5μ or more was present in dots, resulting from the aggregation of the extremely fine particles.

The resultant medium powder was used as a toner, and 0.3% by weight of hydrophobic silica was mixed with the toner to prepare a developer. The prepared developer was supplied to a copier NP-270RE to effect a copying test. The results showed that the duplicated images had increased fog as compared with those obtained in Example 1.

EXAMPLE 2

| | |
|---|---|
| Styrene-acrylic acid ester resin (weight ratio of styrene to the acrylic ester 7:3, weight-average molecular weight of about 300,000) | 100 wt. parts |
| Magnetite (particle size: 0.2μ) | 60 wt. parts |
| Low molecular weight polypropylene (weight-average molecular weight of about 10,000) | 2 wt. parts |
| Negatively chargeable control agent (Bontrone E81) | 2 wt. parts |

A toner feed material of a mixture having the above prescription was melt-kneaded at 180° C. for about 1.0 hour, and cooled for solidification. The resulting mixture was roughly pulverized into particles of 100 to 1000μ in a hammer mill and then moderately pulverized into a weight-average particle size of 50μm pulverized into in ACM pulverizer available from Hosokawa Micron K.K. Then, the pulverized material was further pulverized by means of a hypersonic speed jet mill (PJM-I-10, mfd. by Nippon Pneumatic Kogyo K.K.) into a pulverized material having a weight-average particle size of 7.1 μm (containing 12.0 wt. % of particles having sizes below 4.0 μm and 4.0 wt. % of particles having sizes above 12.7 μm). The pulverized material was classified in an apparatus system as shown in FIG. 3 including a multi-division classifier 1 as shown in FIGS. 1 and ELBOW JET® EJ-45-3 model, available from Nittetsu Kogyo K.K.), into which the pulverized material was introduced at a rate of 2.0 kg/min to be classified into three fractions including a coarse powder, a medium powder and a fine powder under utilization of the Coanda effect.

For effecting the introduction, the collecting cyclones 4, 5 and 6 communicated with the outlets 11, 12 and 13 were operated to generate a reduced pressure in the classification chamber, by which the pulverized material was introuuced at a velocity of about 110 m/sec through the supply nozzle 16. At this time, the static pressure $P_1$ in the intake pipe 14 at a point upstream of the inlet to the chamber was controlled at −420 mm.aq., and the static pressure $P_2$ in the intake pipe 15 was controlled at −70 mm.aq. The introduced particles were classified in an instant of 0.01 second or less. A medium powder suitable as a toner was collected in a yield of 84 wt. % in the collecting cyclone 5 for collecting the classified medium powder, and had a weight-average particle size of about 7.5μ (containing 2.5 wt. % of particles having a particle size of 4.0μ and 0.1 wt. % or less, i.e., a substantially negligible amount, of particles having a particle size of above 12.7μ). Substantially no aggregate of about 3μ or larger resulting from the aggregation of extremely fine particles was found by the observation of the obtained medium powder through an electron microscope.

EXAMPLE 3

| | |
|---|---|
| Styrene-acrylic acid ester resin (weight ratio of styrene to the acrylic ester 7:3, weight-average molecular weight of about 300,000) | 100 wt. parts |
| Magnetite (particle size: 0.2μ) | 60 wt. parts |
| Low molecular weight polypropylene (weight-average molecular weight of 15,000) | 2 wt. parts |
| Negatively chargeable control agent (Bontrone E81) | 2 wt. parts |

A toner feed material of a mixture having the above prescription was melt-kneaded at 180° C. for about 1.0 hour, and cooled for solidification. The resulting mixture was roughly pulverized into particles of 100 to 1000μ in a hammer mill and then moderately pulverized into a weight-average particle size of 30μm in ACM pulverizer available from Hosokawa Micron K.K. Then, the pulverized material was further pulverized by means of a hypersonic speed jet mill (PJM-I-10, mfd. by Nippon Pneumatic Kogyo K.K.) into a pulverized material having a weight-average particle size of 5.8μm (containing 13.0 wt. % of particles having sizes below 3.17 μm and 3.9 wt. % of particles having sizes above 10.08 μm). The pulverized material was classified in an apparatus system as shown in FIG. 3 including a multi-division classifier 1 as shown in FIGS. 1 and ELBOW JET ® EJ-45-3 model, available from Nittetsu Kogyo K.K.), into which the pulverized material was introduced at a rate of 2.0 kg/min to be classified into three fractions including a coarse powder, a medium powder and a fine powder under utilization of the Coanda effect.

For effecting the introduction, the collecting cyclones 4, 5 and 6 communicated with the outlets 11, 12 and 13 were operated to generate a reduced pressure in the classification chamber, by which the pulverized material was introduced at a velocity of about 120 m/sec through the supply nozzle 16. At this time, the static pressure $P_1$ in the intake pipe 14 at a point upstream of the inlet to the chamber was controlled at −600 mm.aq., and the static pressure $P_2$ in the intake pipe 15 was controlled at −70 mm.aq. The introduced particles were classified in an instant of 0.01 second or less. A medium powder suitable as a toner was collected in a yield of 81 wt. % in the collecting cyclone 5 for collecting the classified medium powder, and had a weight-average particle size of about 6.2μ (containing 2.0 wt. % of particles having a particle size of below 3.17μ and 1.0 wt. % of particles having a particle size of above 10.08μ). Substantially no aggregate of about 3μ or larger resulting from the aggregation of extremely fine particles was found by the observation of the obtained medium powder through an electron microscope.

COMPARATIVE EXAMPLE 2

Example 1 was repeated except that the pulverized material was introduced at a rate of 65 m/sec, the static pressure $P_1$ was changed to −200 mm.aq., and the static pressure $P_2$ was changed to −150 mm.aq. As a result, the stream of the fed pulverized material was biased toward the Coanda block 26 to cause an insufficient dispersion in the classifying zone, whereby the separation of the coarse powder, the medium powder and the fine powder was insufficient.

The particles recovered as the medium powder fraction had an average particle size of 11.2 μm, whereas they contained about 1 wt. % of particles having a particle size below 5.04 μm and about 2 wt. % of particles having a particle size of above 20.2 μm, thus showing a clearly broader particle size distribution compared with that of Example 1.

What is claimed is:

1. A process for size separation of a toner for developing electrostatic latent image, comprising:

generating a reduced pressure in a classifying chamber which is divided into at least three sections including a coarse powder section having a first outlet for withdrawing a coarse powder, a medium powder section having a second outlet for withdrawing a medium powder, and a fine powder section having a third outlet for withdrawing a fine powder, by sucking the classifying chamber through at least one of the first to third outlets;

supplying to the classifying chamber a feed toner material comprising toner particles of 20 μm or less in particle size in a proportion of 50% or more by number through a supply pipe having a supply nozzle opening into the classifying chamber at a velocity of 50 m/sec to 300 m/sec along with a gas stream flowing through the pipe;

controlling the absolute value of a static pressure $P_1$ to 150 mm.aq. or above in a first gas introduction pipe having a first gas inlet opening into the classifying chamber at a position upstream of the first gas inlet by a first gas introduction control means;

controlling the absolute value of a static pressure $P_2$ to 40 mm.aq. or above in a second gas introduction pipe having a second gas inlet opening into the classifying chamber at a position just upstream of the second gas inlet by a second gas introduction control means, the second gas inlet being disposed farther than the first gas inlet with respect to the supply nozzle; and distributing the feed toner material supplied to the classifying chamber into at least the coarse powder section, the medium powder section and the fine powder section utilizing inertia force of the feed toner particles in the gas stream and centrifugal force of the curved gas stream imparted by a Coanda effect, wherein the absolute value $|P_1|$ of the static pressure $P_1$ and the absolute value $|P_2|$ of the static pressure $P_2$ satisfying the relation of $|P_1|-|P_2| \geqq 100$ (mm.aq.).

2. A process according to claim 1, wherein the reduced pressure in the classification chamber is generated by sucking the classification chamber through all of the first to third outlets.

3. A process according to claim 2, wherein the sucking of the classifying chamber is effected by a collecting cyclone.

4. A process according to claim 1, wherein the feed toner material is supplied to the classifying chamber at a velocity of 70–200 m/sec through the supply nozzle.

5. A process according to claim 1, wherein the absolute value $|P_1|$ of the static pressure $P_1$ is 200 mm.aq. or above.

6. A process according to claim 5, wherein the absolute value $|P_1|$ of the static pressure $P_1$ is 210 to 1000 mm.aq.

7. A process according to claim 1, wherein the absolute value $|P_2|$ of the static pressure $P_2$ is 45 to 400 mm.aq.

8. A process according to claim 7, wherein the absolute value $|P_2|$ of the static pressure $P_2$ is 45 to 70 mm.aq.

9. A process according to claim 1, wherein the absolute value $|P_1|$ of the static pressure $P_1$ and the absolute value $|P_2|$ of the static pressure $P_2$ satisfy the relations of:

$150 \leqq |P_1|-|P_2| \leqq 700$, and $|P_1|/|P_2|=2$ to 10.

10. A process according to claim 1, wherein the static pressures $P_1$ and $P_2$ are respectively controlled by a damper.

* * * * *